US008405547B2

(12) United States Patent
Gianinni et al.

(10) Patent No.: US 8,405,547 B2
(45) Date of Patent: Mar. 26, 2013

(54) SELF-PROVISIONING ANTENNA SYSTEM AND METHOD

(76) Inventors: Mark Gianinni, Tierra Verde, FL (US); Steven Lyons, Largo, FL (US); Steven L. Myers, Parkland, FL (US)

( * ) Notice: Subject to any disclaimer, the term of this patent is extended or adjusted under 35 U.S.C. 154(b) by 159 days.

(21) Appl. No.: 12/927,990

(22) Filed: Dec. 1, 2010

(65) Prior Publication Data

US 2012/0139788 A1 Jun. 7, 2012

(51) Int. Cl.
*H01Q 3/00* (2006.01)

(52) U.S. Cl. ..... 342/372

(58) Field of Classification Search ..... 342/372
See application file for complete search history.

(56) References Cited

U.S. PATENT DOCUMENTS

| | | | | |
|---|---|---|---|---|
| 3,248,730 | A | 4/1966 | Neymeyer | |
| 5,179,386 | A | 1/1993 | Rudish et al. | |
| 5,493,310 | A | 2/1996 | Ota | |
| 5,767,807 | A | 6/1998 | Pritchett | |
| 5,983,071 | A | 11/1999 | Gagnon et al. | |
| 6,229,486 | B1 | 5/2001 | Krile | |
| 6,268,828 | B1 | 7/2001 | Martek | |
| 6,552,695 | B1 | 4/2003 | Strickland | |
| 6,771,986 | B1 * | 8/2004 | Oh | 455/562.1 |
| 7,016,702 | B2 * | 3/2006 | Chitrapu | 455/562.1 |
| 7,088,306 | B2 | 8/2006 | Chiang et al. | |
| 7,123,876 | B2 | 10/2006 | Wang et al. | |
| 7,398,049 | B2 | 7/2008 | Blodgett et al. | |
| 7,421,321 | B2 | 9/2008 | Breed et al. | |
| 7,720,511 | B1 | 5/2010 | Hanley et al. | |
| 2003/0206140 | A1 | 11/2003 | Thornberg et al. | |
| 2004/0051676 | A1 | 3/2004 | Travis et al. | |
| 2005/0057432 | A1 | 3/2005 | Anderson | |

FOREIGN PATENT DOCUMENTS

| | | |
|---|---|---|
| EP | 1517398 | 3/2005 |
| WO | WO 9428595 | 12/1994 |
| WO | WO 03043124 | 5/2003 |

* cited by examiner

*Primary Examiner* — Harry Liu
(74) *Attorney, Agent, or Firm* — Sidney W. Kilgore, P.A.; Sidney W. Kilgore

(57) ABSTRACT

A self-provisioning antenna (SPA) system and method provides for automatic simultaneous remote optimization of one or more field antenna terminals over a wireless network. A central server communicates with a field controller to modify configurations of any directional radiating elements, filters settings, and low noise amplifier settings associated with one or more remotely located antenna banks, determines the optimal configurations based on readings of field signal quality metrics including RSSI, EC/IO, and date rate standard samples, and allows a human operator to select a configuration.

19 Claims, 14 Drawing Sheets

SELF-PROVISIONING ANTENNA SYSTEM AND METHOD

CROSS-REFERENCES TO RELATED APPLICATIONS

Not applicable.

STATEMENT REGARDING FEDERALLY SPONSORED RESEARCH OR DEVELOPMENT

Not applicable.

MICROFICHE APPENDIX

Not applicable.

BACKGROUND OF THE INVENTION

1. Field of the Invention

This invention relates to the field of antennae, and particularly, to means of remotely and automatically optimizing field antennae utilized in deployment of wireless broadband telecommunications networks.

2. Description of Related Art

In the telecommunications industry, the term 'provisioning' commonly refers to the process of preparing and equipping a network to allow it to provide new services to end-users (customers). In wireless telecommunications networks, directional antennae, which radiate more in one direction than in another, are often used to enhance carrier signal transmission and reception. By careful arrangement of length, spacing, and orientation, as well as through the addition of rods, loops, or plates, antennae with desired directional properties can be created.

When two or more simple antennae are combined to produce a specific directional radiation pattern, the result is an antenna array (antenna bank). The directionality of an antenna array arises from the spatial relationships and electrical feed relationships between individual antennae or directional radiating elements of the array. Through 'beamforming,' a term referring to a signal processing technique used in sensor arrays for directional signal transmission or reception, including radio or sound waves, spatial selectivity is achieved by using adaptive or fixed receive/transmit beam patterns. The resulting improvement over that of an omni-directional reception and transmission signal is known as receive/transmit gain.

Wireless broadband deployment of telecommunications networks can be costly and time-consuming when traditional manual methods of provisioning directional antennas are used. Typically, the provisioning of directional antennas to achieve optimal signal strength from a given cellular carrier requires coordination between a field technician who can manipulate manually the two or more directional radiating elements within an antenna array to produce a specific directional radiation pattern, and a central technician who can evaluate the results of different configurations on overall signal strength while communicating with the field technician via radio, cell phone, or other means as the directional radiating elements are manipulated. As a consequence, provisioning of antennae must be carried out serially rather than in parallel, such that only one antenna system may be provisioned at a time in a single discrete remote location. What is needed is a means for automating the provisioning process to allow the provisioning of any number of antennae in any number of discrete locations remotely.

BRIEF SUMMARY OF THE INVENTION

A self-provisioning antenna (SPA) system and method provides for automatic simultaneous remote optimization of one or more field antenna terminals operating generally within the UHF radio spectrum. A central server computer (central server) communicates with a field controller located at each remote SPA site (field site or terminal site) to configure one or more SPA terminals comprised of sets of antenna arrays (antenna banks) at each such site, typically through the use of modems over a wireless network, such as a cellular telephone network. Each set of antenna banks may include a primary antenna bank and a secondary or diversity antenna bank.

Upon initiation by a human operator, the central server tests each antenna bank at a selected SPA site, beginning with a primary antenna bank with transmit and receive (Tx and Rx) capability. The central server tests an antenna bank by first determining the number of directional radiating elements for a given bank, then testing (taking readings of) the signal strength of the antenna bank while all the elements in the antenna bank are operating in concert (omni-directionally), and configuring and testing for each element within that bank individually as well.

The central server takes multiple sample readings from an SPA terminal. First, data are generated with respect to Received Signal Strength Indication (RSSI), being a measurement of the power present in a received radio signal. Second, measurements are taken of EC/IO, being the ratio of received pilot energy, EC, to total received energy or the total power spectral density, IO, expressed in decibels. Third, measurements of data rate standards are taken to determine the quality of broadband service availability.

There are two such standards currently prevalent in the United States: Code Division Multiple Access (CDMA) and Global System for Mobile Communications (GSM). These measurements of data rate standards are based on either the High Speed Packet Access (HSPA) protocol or EV-DO Rev. A. (a 3G CDMA technology that is an upgrade of traditional EV-DO). Other standards, such as Worldwide Interoperability for Microwave Access (WIMAX) and Long Term Evolution (LTE), are also developing greater use. The central server calculates a link quality score based on the samples generated while all the directional radiating elements associated with an antenna bank are activated (omni-directional mode) and while individual directional radiating elements associated with an antenna bank are activated, then determines which configuration of the antenna bank produces the highest score, and sets the antenna bank to this configuration.

A primary antenna bank may include an addressable array of filters to enhance signal reception. In the case of a diversity antenna bank, an addressable array of filters or an addressable low noise amplifier (LNA) or both, may be included to enhance signal reception. The central server additionally will apply one or more LNA settings to each element within a diversity antenna bank before setting the diversity antenna and LNA to the configuration found to be optimal. Similarly, the central server will test the signal strength of each configuration of an antenna bank while using no filter and compare it to the signal strength achieved using any filter or combination of filters that may be employable, and then set the filter array accordingly.

The test is finalized by displaying the recommended (current) settings to the human operator, who may approve or disapprove of the recommended settings. If the human operator disapproves of the recommended settings, alternative choices based on the next highest and best configurations, as well as a default choice to set the primary antenna bank omni-directionally and to turn any diversity antenna bank off, will be presented to the human operator for his selection and approval. If no settings are acceptable, the human operator may be advised that an installation failure has occurred.

The SPA system and method performs the functions described above through a series of software modules executing on the central server. One module, the test configuration module (TCM), conducts a test configuration process that ensures the functionality of the modem connection between the central server and the field controller, takes RSSI, EC/IO, and data rate standard samples, and ensures that a sufficient number of samples have been acquired. The test configuration module then calls a second module to calculate an overall link quality score based on the RSSI, EC/IO, and data rate standard samples, and records the score returned.

DETAILED DESCRIPTION OF THE INVENTION

1. The SPA System

Figure 1:
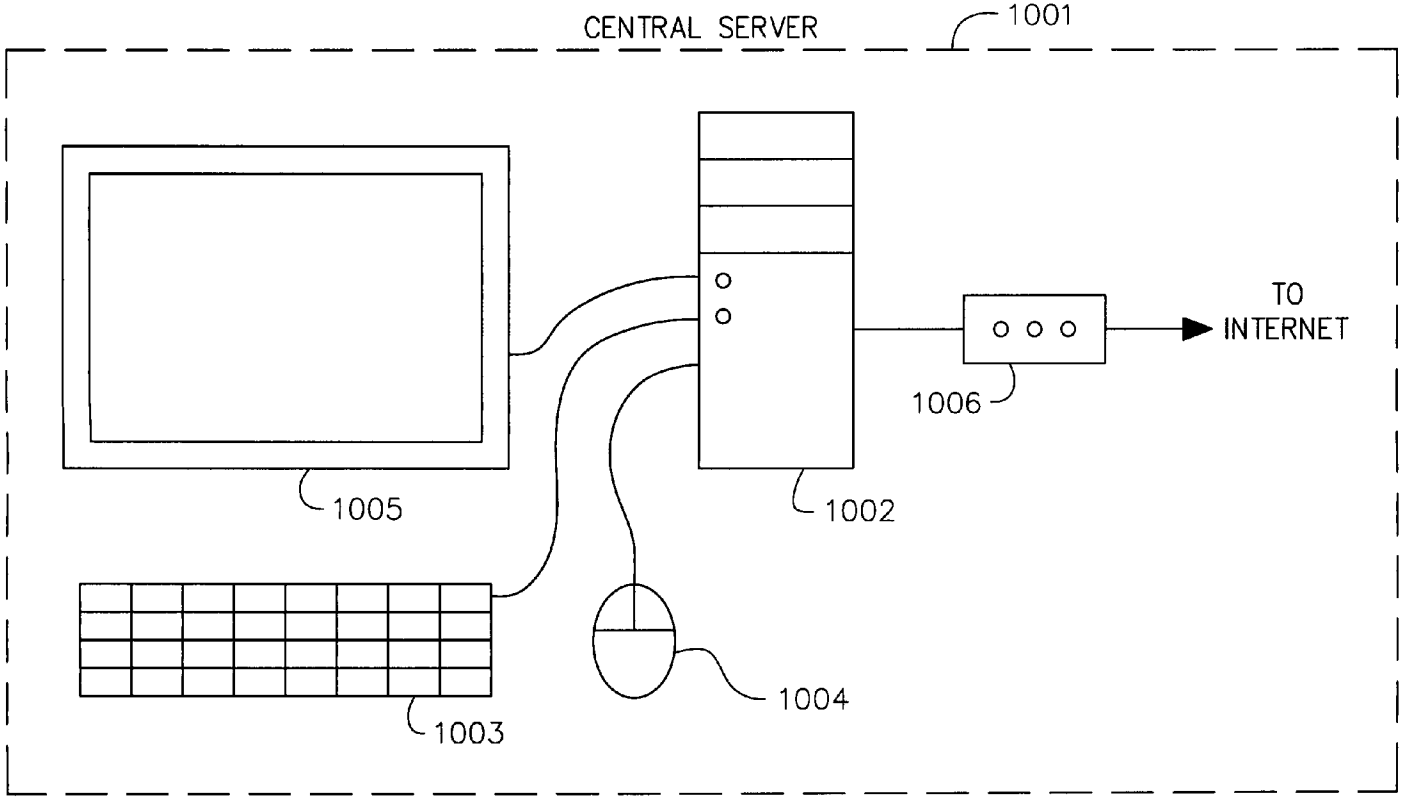
FIG. 1 Central Server
FIG. 2 Wireless Networks
FIG. 3 Field Terminal
FIG. 4 A-E Flow Chart of Main Process
FIG. 5 Flow Chart of TCM
FIG. 6 A-E Flow Chart of CLQSM

FIG. 1 illustrates a central server 1001 comprised of a computer 1002 with input means and output means to allow a human operator to interact with it. Input means may be, by way of example but not limitation, a keyboard 1003 or a mouse 1004, or both. Output means may be, without limitation, a CRT 1005 or any other form of output display. The central server may be connected to the Internet via a modem (central modem) 1006.

Figure 2:
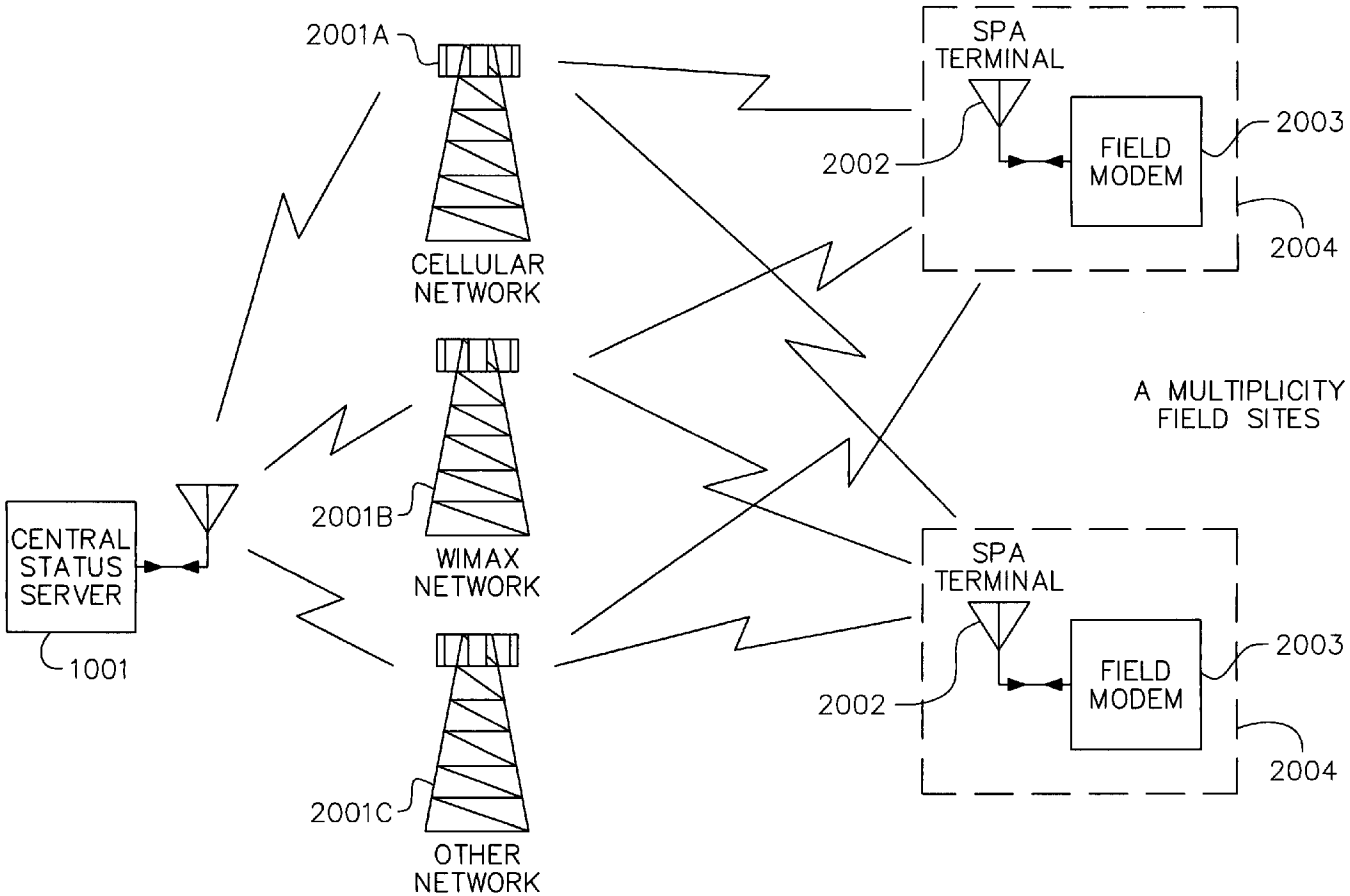

As illustrated in FIG. 2, the central server 1001 may communicate over the Internet via a wireless network 2001 A-C with a multiplicity of remote SPA terminals 2002 coupled to field modems 2003 at a multiplicity of remote field sites 2004. The wireless network could be a cellular telephone network 2001A, Worldwide Operability for Microwave Access (WIMAX) network 2001B, or another form of wireless network 2001C. Typically, a cellular telephone network would employ either a mobile telephone standard based on Code Division Multiple Access (CDMA), such as Interim Standard 95 (IS-95) or CDMA2000 (also known as IMT Multi-Carrier (IMT-MC)), used by carriers such as Sprint® and Verizon Wireless®, or the Global System for Mobile Communications (GSM), used by carriers such as AT&T®.

The field modem 2003 accepts a Transmission Control Protocol (TCP) connection from the central server 1001 and converts data received over that connection into serial data. Similarly, any serial data originating at the SPA terminal 2002 will be sent to the central server 1001 via the field modem 2003.

A modem is a radio transceiver designed for data. It generally can operate on a limited set of channels or bands, for example, spanning 824-896 MHz and 1850-1990 MHz in order to operate within cellular networks within the United States. The modulation and protocol scheme is designed to meet the standard used by a given cellular carrier, e.g., CDMA or GSM. One embodiment of the current invention could use a field modem 2003 that includes a programmable microprocessor and memory (not illustrated), such as the Airlink® modem manufactured by Sierra Wireless, Inc. In this case, the SPA terminal 2002 can exploit the existing processor and memory within the field modem 2003 to provide means to execute desired field functionality.

Generally, each SPA terminal 2002 will be situated at a remote field site 2004 that is an end-user (customer) location. Through the SPA terminal 2002, an end-user gains stable and reliable Internet access, as well as other forms of data access. Because the SPA system is self-provisioning, no customer action is required to make an interne connection reliable, nor does the customer have to monitor and point the antenna to effectuate the optimal interne connection to determine if a signal booster is needed, or otherwise to invest time and resources in realizing acceptable link performance.

Figure 3:
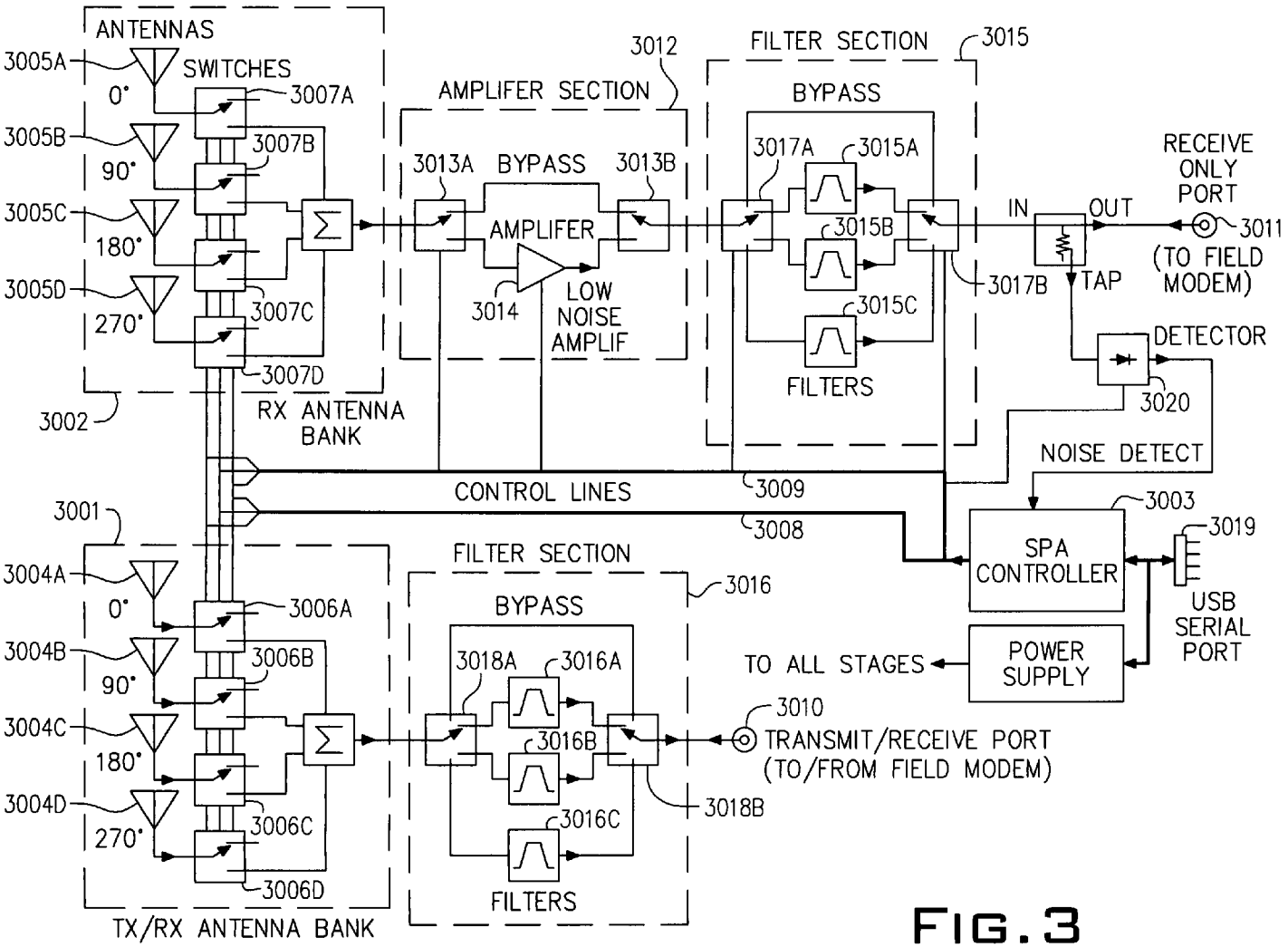

FIG. 3 illustrates an SPA terminal in one embodiment of the invention. The SPA terminal has two antenna banks 3001, 3002, comprising a primary antenna bank 3001 and a secondary or diversity antenna bank 3002. The primary antenna bank 3001 and the secondary antenna bank 3002 are generally separated a substantial distance apart, within a range of six (6) to eighteen (18) inches.

The use of a set of at least two antenna banks 3001, 3002 exploits the spatial diversity capabilities of the field modem 2003 to which a field controller 3003 may be coupled. Spatial diversity allows the SPA system to limit the depth of signal multipath cancellation: in an environment where one or more objects capable of reflecting the radio frequency (RF) carrier of the network signal are in close proximity, the RF wave can traverse multiple paths to reach the field antenna. If two such paths differ in length by an odd multiple of a half wavelength, so that their polarities are opposite, and if their intensities (amplitudes) are approximately equal, full cancellation of the signal occurs at a location in space.

Different combinations of path lengths and amplitudes provide varying degrees of multipath cancellation values. The use of at least two antenna banks, therefore, serves to achieve a measure of multipath immunity, as signal cancellation is localized. That is, when one of the two antenna banks is at a signal null, the second antenna bank generally is not so, thus limiting possible disruption of communications. This is especially useful where a field site is located indoors, where many objects, including human beings, affect the communications channel, making the need for antenna spatial diversity particularly important, if not virtually essential.

Each antenna bank 3001, 3002 is comprised of one or more directional radiating elements 3004 A-D, 3005 A-D, each of which may be vertically polarized to match any existing network infrastructure polarization. By way of example, but not limitation, each antenna bank could have four directional radiating elements, spaced in a square pattern with each such element located at a corner of the square, such that the four directional elements point 90° apart (360°/4) with a beamwidth of approximately a quadrant. The antenna banks could include Logarithmic Periodic arrays or multi-resonant Yagi-Uda arrays, among others.

Each antenna bank 3001, 3002 further comprises means of controlling the respective orientations of each of the directional radiating elements. In one embodiment of the invention, discrimination between individual directional radiating elements 3004 A-D, 3005 A-D within an antenna bank is carried out through switching means 3006 A-D, 3007 A-D that activate or deactivate said elements. These means may comprise a configuration of RF switches, one for each of the directional radiating elements in an antenna bank. The switches, which may be combined to provide a single output, may be within an integrated circuit, such that the switches have no moving parts, make no noise, and enjoy relatively long lifespans. Other types of switches, however, such as mechanical, relay, or MEMS switches, may be employed to configure the elements within each antenna bank.

Closing one of the switches will connect its respective directional radiating element to the modem through an antenna port. For example, closing the switch 3006 A for the first directional radiating element 3004 A of the primary antenna bank 3001 will activate the first directional radiating element 3004A. Any combination of such elements within an antenna bank may be thus activated. In an antenna bank containing four directional radiating elements as described above, when all four corresponding switches are enabled, all four quadrants are activated, and the antenna bank operates in an omni-directional fashion.

While both antenna banks in a two-bank embodiment of the invention generally may be configured identically, the switching means 3006 A-D, 3007 A-D also enable independent antenna bank optimization to exploit fully quadrant-level diversity as well as spatial diversity. Each antenna bank has its own set of control lines 3008, 3009 to the SPA controller for controlling, among other things, the switches for the antenna bank.

In a two-bank embodiment of the invention, there can be asymmetrical antenna ports for the primary antenna bank 3001 and for the diversity antenna bank 3002, each of which may be tied into a field modem 2003 at the field site 2004. The primary antenna bank 3001 has a transmit/receive (Tx/Rx) port 3010, while the diversity antenna bank 3002 typically has a receive-only (Rx) port 3011.

A port of an antenna bank can include a number of signal-conditioning capabilities. The introduction of a Low Noise Amplifier (LNA) section 3012 to the receive-only (Rx) 3011 port of a diversity antenna bank 3002 allows the insertion of approximately 15 decibels (dB) of gain with a low Noise Figure of approximately 3 dB. This architecture can minimize transmit power losses, thus avoiding the need for a bi-directional booster (there being no amplification in the transmit (Tx) path). A bi-directional booster generally has Noise Figures of 6 dB and greater, due to internal diplexer losses, compared to the 3 dB Noise Figure generated by the amplifier section for the receive-only (Rx) port.

Switching means 3013 A-B, controlled by an SPA controller 3003 through control lines 3009 to a diversity antenna bank 3002, may be used to enable or disable and bypass any LNA 3014. Again, any number of types of switches may be used, including, but not limited to, integrated circuits. By embedding an LNA 3014, the overall system Noise Figure for the field site is lowered, providing enhanced sensitivity by lowering the noise floor. This can be particularly important where long runs of coaxial cable between the antenna ports 3010, 3011 of the antenna banks 3001, 3002 and the field modem 2003 are necessary. Without an LNA 3014, all losses leading up to the field modem 2003 erode sensitivity. In contrast, with the introduction of an embedded LNA 3014, the sensitivity of the SPA terminal 2002 is not significantly affected by losses of up to 9 dB.

An embodiment of the invention may further include, in either the transmit/receive (Tx/Rx) path 3010 of a primary antenna bank 3001 or in the receive-only (Rx) 3011 path of a diversity antenna bank 3002, or in both, one or more filter sections (filter arrays) 3015, 3016 comprised of up to three filters 3015 A-C, 3016 A-C each. Individual filters may be selected as desired through switching means 3017 A-B, 3018 A-B coupled to an SPA controller 3003 via control lines 3008, 3009 to an antenna bank 3001, 3002. Additional filters are possible through the use of a switch with additional positions, or using more than one switch. Any number of switch types may be employed, including integrated circuits. An embodiment with a single filter array usually will include three filters, typically one within the 869-894 MHz range, one within the 1930-1990 MHz range, and one within the 2110-2170 MHz range to accommodate cellular frequencies and the Universal Mobile Telecommunications System (UMTS) architecture used in 3G and 4G cellular networks; however, any desired combination of filters may be used to support the RF spectrum for a given location.

An SPA controller 3003 is comprised of a low noise microprocessor (not illustrated), which may be, for example, an Atmel® ATmega 128 series microprocessor or a PIC® 18F2525K22 series microprocessor, as well as a communication interface, such as a USB interface 3019. If a USB interface 3019 is used to connect an SPA controller 3003 to a field modem 2003, power to the SPA controller 3003 can be supplied from the field modem 2003 through the USB interface 3019.

An SPA controller 3003 communicates with the central server 1001, receiving, acknowledging and executing the latter's commands to configure the respective orientations of the directional radiating elements 3004 A-D, 3005 A-D within antenna banks 3001, 3002, activating or deactivating any LNA 3014, or activating or deactivating any filter 3015 A-C, 3016 A-C in any filter array 3015, 3016. Usually a single SPA controller 3003 is responsible for configuring all of the hardware at the field site—the directional radiating elements 3004 A-D, 3005 A-D within the one or more antenna banks 3001, 3002, any LNA 3014, and any filter arrays 3015, 3016—and remembering the current and previous settings of all switches 3006 A-D, 3007 A-D, 3013 A-B, 3017 A-B, 3018 A-B. An SPA controller may also be used for monitoring certain internal system parameters, such as power supply and LNA voltages, and receiving output from an RF Noise Detector 3020, which may be installed at the field site to report strong signals, generally from sources local or close to the field site.

The primary function of any such RF Noise Detector 3020 is to provide historical feedback and assist in troubleshooting the link quality of a location with sporadic outages or sub-par performance of the SPA terminal 2002. The sensitivity of the RF Noise Detector 3020 may vary between −50 dBm and −65 dBm, depending on whether an LNA 3014 is included in the embodiment and enabled. The RF Noise Detector 3020 reports the level of noise to the field controller as a varying voltage. This voltage is converted to a numeric figure through an Analog to Digital (A/D) converter, which is a peripheral within microprocessors such as the ATmega128. Readings are typically accurate to within 1-2 dB.

2. The SPA Method a. Communication Generally.

The SPA method is calculated to minimize the amount of manual intervention required for the turn-up of new deployments of wireless Internet access in remote field sites. The central server 1001 and any SPA controller 3003, when communicating via modems over a TCP connection, will do so in a simple command/response format. The central server 1001 will send a command to an SPA controller 3003, and the SPA controller 3003 will respond with an indication to the central server 1001 to acknowledge that the command has been carried out. Depending on the command, the SPA terminal 2002 may send back detailed information in the response.

To assess the optimal configuration for a given deployment, the central server 1001 will log into a field modem 2003. By accessing the field modem 2003 over telnet—a network protocol used on the Internet or on local area networks to provide bi-directional interactive text-oriented communications facility via a virtual terminal connection—the central server 1001 will be able to ascertain information regarding the wireless signal (field signal quality metrics) such as received signal strength and signal-to-noise ratio.

Generally, to determine the optimal configuration of the SPA terminal 2002, upon initiation by a human operator, the central server 1001 will send commands to a selected SPA controller 3003 ordering it to activate all of the directional radiating elements 3004 A-D, 3005 A-D within an antenna bank 3001, 3002 (placing the antenna bank in omni-directional mode) and test (taking readings of) wireless signal strength, and will further activate each directional radiating element within an antenna bank individually and test the wireless signal strength for each individual element. Configurations that include activation or deactivation of one or more filters 3015 A-C, 3016 A-C in one or more filter arrays 3015, 1316, and activation or deactivation of one or more low noise amplifiers 3014 at various settings, may also be implemented and tested. By comparing the results obtained for each configuration associated with an antenna bank 3001, 3002, the central server can decide what the best overall configuration appears to be and will provide alternative choices to the human operator, who can then specify whether to accept a given configuration and order the SPA terminal to operate with that configuration.

b. Control Commands and Response Format

Commands and responses may be transmitted in plain text. A newline character (hex value 0A) may be used to terminate individual commands and responses. To acknowledge receipt of a properly formed command, the SPA terminal will echo back the command before executing it. If the SPA terminal does not recognize a command, it will return an error message along with the command it received.

To describe the command formats, the following notation is used:

- x indicates an integer representing a bit-mapped value showing which directional radiating elements within a given antenna bank are activated. For example a value of 15 (1111 in binary) for an antenna bank with four directional radiating elements indicates that it is operating in an omni-directional state (i.e., all directional radiating elements are on).
- z indicates an integer representing a given antenna bank (in a typical two-bank embodiment, for example, "1" may refer to the primary antenna bank and "2" may refer to the secondary or diversity antenna bank.
- y indicates an integer representing a length of time in minutes.
- f indicates an integer representing a bit-mapped value showing which filters in a given filter array are enabled.
- g indicates an integer representing the level of gain for the LNA. The value of g represents the level of gain in dB to which the LNA should be set (a value of "0" meaning that the LNA should be turned off). The valid range for g is 0 to 24.

When multiple values are listed inside square brackets ("[ ]") and separated by a vertical bar ("|"), this indicates that one and only one of those values will appear in the command.

(1) Status Commands

The following commands may be used to allow the central server to obtain information from the SPA terminal:

"Return CurrentState"

Sends back the currently operating state of directional radiating elements within the antenna bank or banks, the state of any LNA, and the state of the filters in any filter array. The response format is CurrentState x1 x2 g f, where x1 is the state of the elements in the primary antenna bank, x2 is the state of the elements in the diversity antenna bank, g indicates the state of the LNA, and f indicates the state of the filters.

"Return SavedState"

Sends back the configuration saved in non-volatile memory in the SPA controller. The response format is the same as the response to "Return CurrentState"

"Return NumberOfElements"

Sends back the total number of elements per antenna bank. For example, if an antenna bank has four (4) elements, then the response would be "NumberOfElements 4".

(2) Control Commands

The following commands may be used to allow the central server to change the behavior of the SPA terminal.

"Test Element z x y"

Sets antenna bank z into a temporary test mode. During this time, antenna bank z will activate the elements specified by the bitmapped value x while deactivating all other elements not specified by x. For example, an x value of 5 (0101 in binary) directs the SPA controller to turn on directional radiating elements designated 1 and 3 (since the first and the third bits are set to 1), while directing the SPA controller to turn off all the other directional radiating elements. This test lasts for y minutes. After the test is over, the antenna bank returns to the operating state that it was in before the test was initiated (which is not necessarily the same as the configuration saved in non-volatile memory in the SPA controller).

"Test LNA g y"

Sets an LNA into a temporary test mode. During this time, the LNA is set to the amount of gain indicated by the parameter g. The test lasts for y minutes. After the test is over, the LNA returns to the operating state that it was in before the test was initiated (which is not necessarily the same as the configuration saved in non-volatile memory in the SPA controller).

"Test Filter z f y"

Sets antenna bank z into a temporary test mode. During this time, antenna bank z will activate the filters specified by f in a filter array. This test lasts for y minutes. After the test is over, the antenna bank returns its filter array to the operating state that it was in before the test was initiated (which is not necessarily the same as the configuration saved in non-volatile memory).

"Set Element z x"

Sets antenna bank z to activate the directional radiating elements specified by the bitmapped value x while deactivating all other filters not specified by x. For example, an x value of 5 (0101 in binary) directs the SPA controller to turn on elements 1 and 3 (since the first and third bits are set to 1) while telling the SPA controller to turn off the other elements.

"Set LNA g"

Sets an LNA to the amount of gain indicated by the parameter g.

"Set Filter z f"

Sets antenna bank z to activate the filters in a filter array specified by the bitmapped value f while deactivating all other filters not specified by f.

"Save"

Saves the current configuration of directional radiating elements within the antenna bank or banks, any LNA configuration, and the configuration of filters in a filter array to non-volatile memory within the SPA controller.

"Restore"

Sets the current operating configuration to what is saved in non-volatile memory.

c. Process Flow.

FIG. 4 A-E is a high-level flow chart of one embodiment of the main process flow for the SPA method. As illustrated in FIG. 4A, the SPA method begins when a human operator initiates a test 4001 of an SPA terminal for a desired field site using an input device, such as a keyboard or a mouse, or both. Upon initiation by the human operator, the central server attempts to connect to a telnet console 4002. The system will then determine whether the connection succeeds 4003. If the connection does not succeed, the system will continue to try to connect to the telnet console unless and until the operator elects to abort the test. If the connection succeeds, TCP auto-answer for the field modem is enabled 4004, The system will then attempt to connect to the serial pass-through port of the fielder controller 4005, and will then test whether the connection to that serial pass-through port succeeded 4006. Should the connection to the serial pass-through port fail, the system will continue to try to connect to it unless and until the operator elects to abort the test. If the connection succeeds, the central server will send a command to the SPA controller to determine the number of directional radiating elements (elements) for each antenna bank at the field site 4007. The central server will then send a command to the SPA controller to set the primary antenna bank at the field site to omni-directional operation and the diversity antenna bank to off 4007. If switching means are used, this is accomplished simply by activating each of the directional radiating elements within the primary antenna bank and deactivating the directional radiating elements within the diversity antenna bank.

Figure 4A:
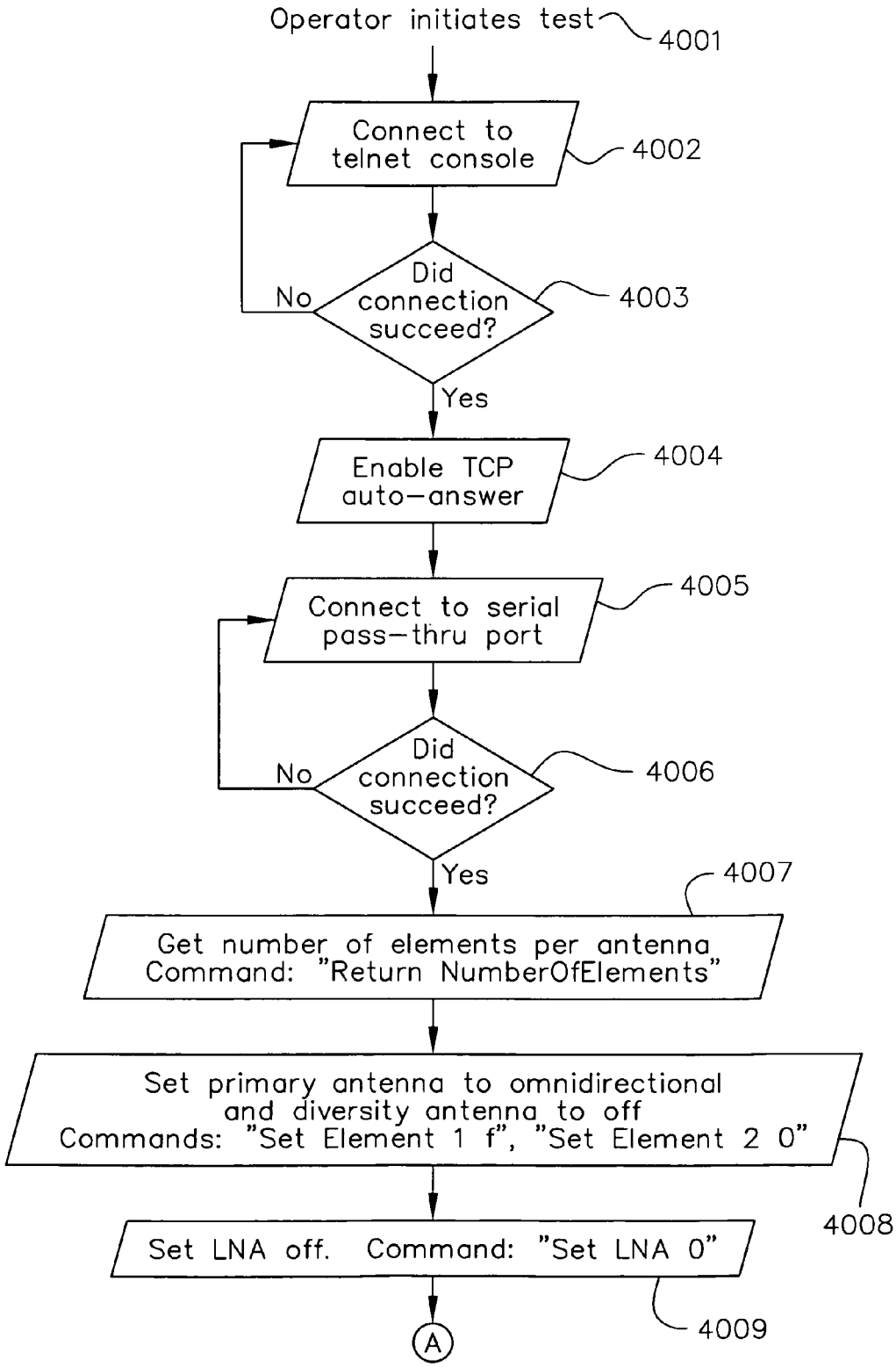
Figure 4B:
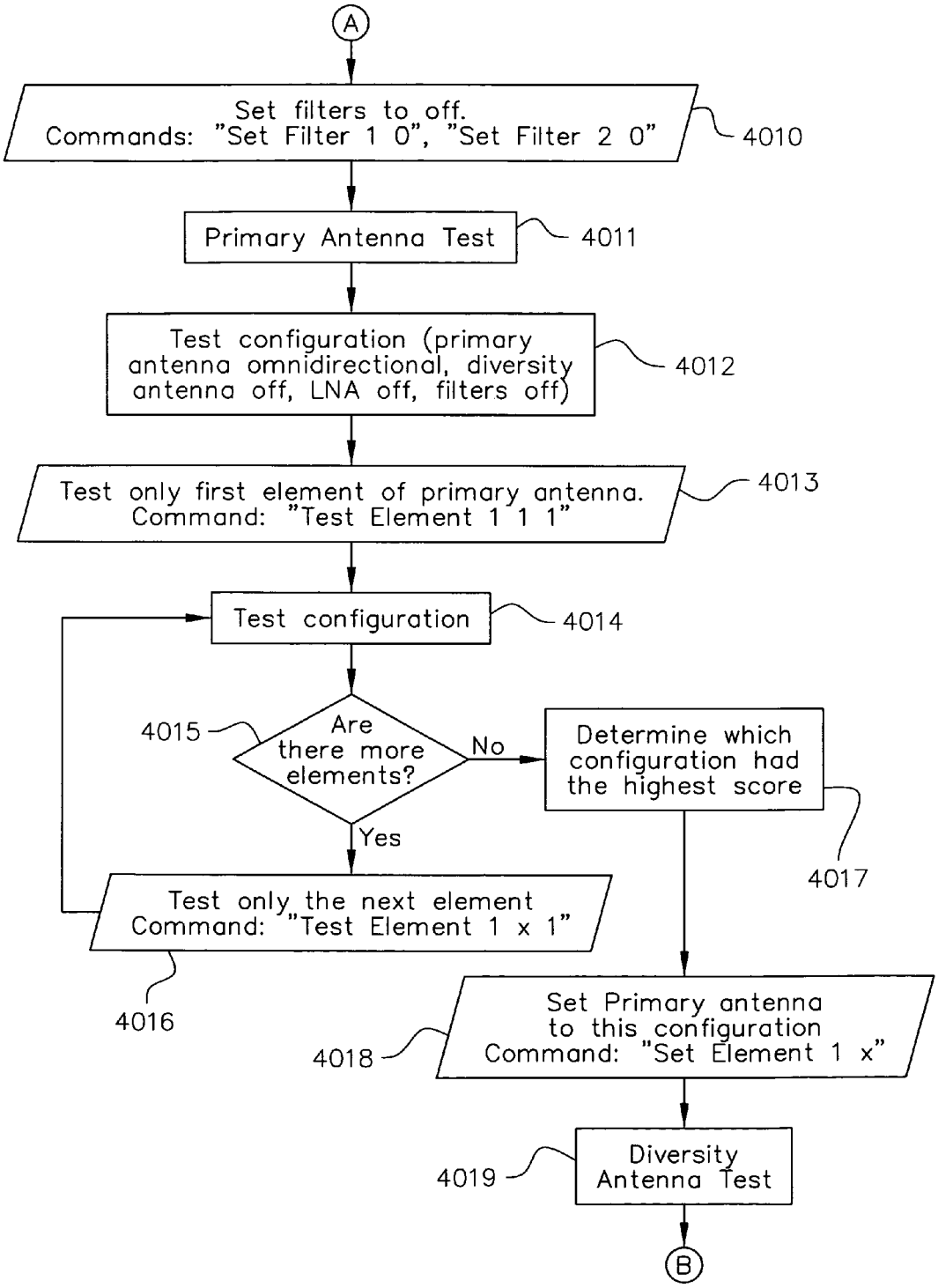

The central server will send a command to the SPA controller to deactivate any LNA 4009. As illustrated in FIG. 4B, it will also deactivate any filters in any filter banks as well 4010. The primary antenna bank will ordinarily be tested first 4011 using a test configuration module (TCM) described more fully below. The TCM may initially test the primary antenna bank in the omni-directional mode, with all the directional radiating elements activated 4012. It may then activate only a first directional radiating element of the primary antenna bank while turning all of the other elements off 4013, and test that first directional radiating element of the primary antenna bank 4014. Following the test, it determines if there are any remaining untested directional radiating elements remaining within the first antenna bank 4014, and if so, the TCM then configures successively each such untested element in this manner (activating the element to be tested while deactivating the remaining elements in the bank) 4015 and tests that element 4014 until there are no remaining untested individual elements within the primary antenna bank. The central server will then determine, based on the results returned by the testing, which configuration of directional radiating elements within the primary antenna bank produced the highest link quality score 4017, and will issue a command to the SPA controller to set the primary antenna bank to this configuration 4018.

Figure 4C:
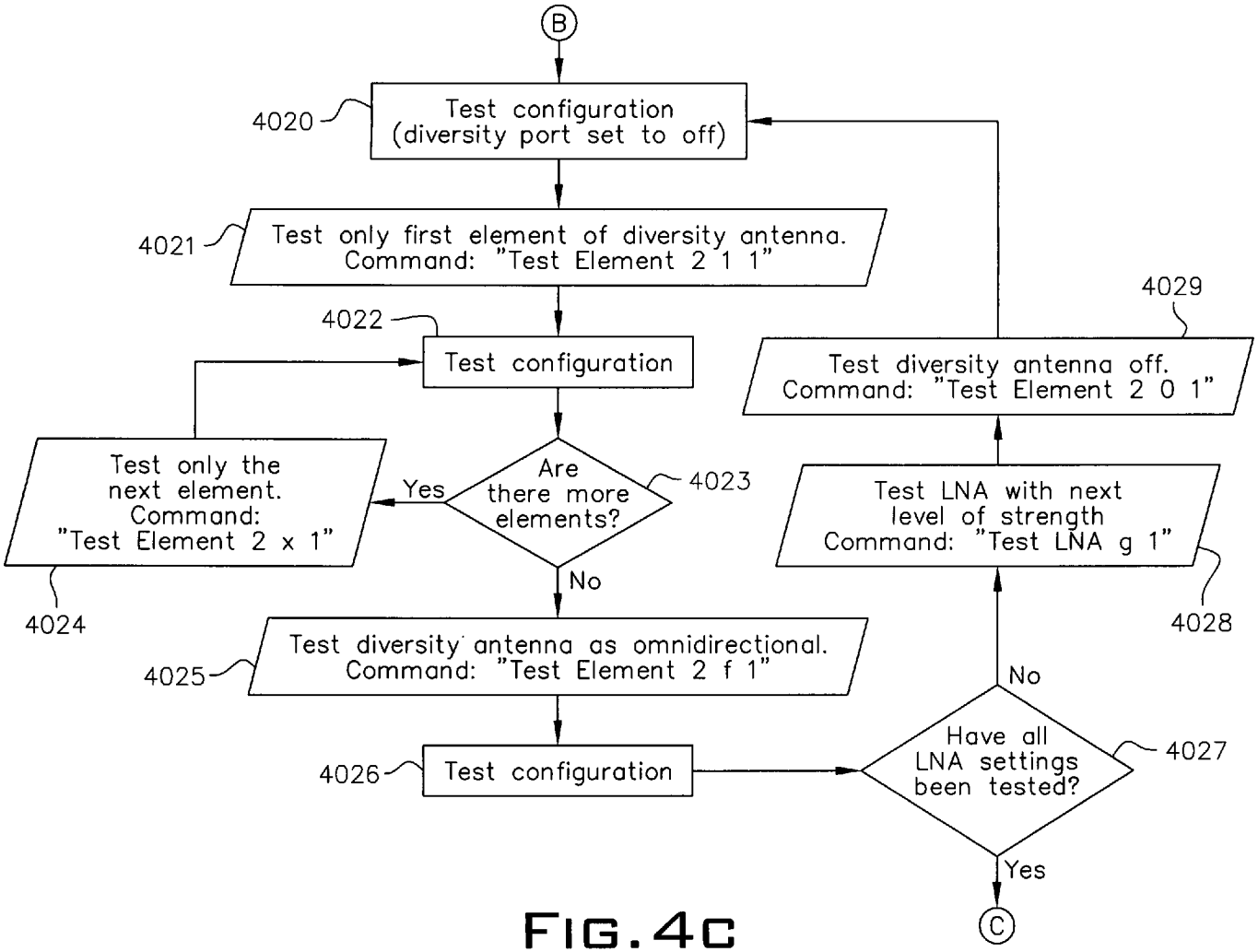

The system next may proceed to test the secondary (diversity) antenna 4019. As illustrated in FIG. 4C, in the initial test configuration, the diversity port is set to off 4020. The system configures a first element of the diversity antenna bank, turning all of the remaining elements in the diversity antenna bank to off 4021. It then tests that element 4022, and determines whether there are remaining elements to be tested 4023. If so, the system will proceed to configure the next element for testing 4024, and proceed to test that next element 4022. If not, the system will then configure the diversity antenna bank in omni-directional mode 4025, and run the test configuration to test the diversity antenna bank in that omni-directional mode 4026.

Following that test, if an LNA is utilized, the central server will issue a command to determine whether all LNA settings have been tested 4027. If all LNA settings have not been tested, the system will configure the LNA with the next greatest level of strength 2028, and the diversity antenna bank will again be set to off 2027. The TCM will then be run again to test each directional radiating element within the secondary antenna bank, as well as test the secondary antenna bank in omni-directional mode, and will again inquire whether all LNA settings have been tested. This iterative process will continue until all LNA settings have been tested. Typically, there may be five LNA settings to test: null, 5 dB, 10 dB, 15 dB, and 20 dB. These variations in LNA settings could affect RSSI, EC/IO, or network service.

Figure 4D:
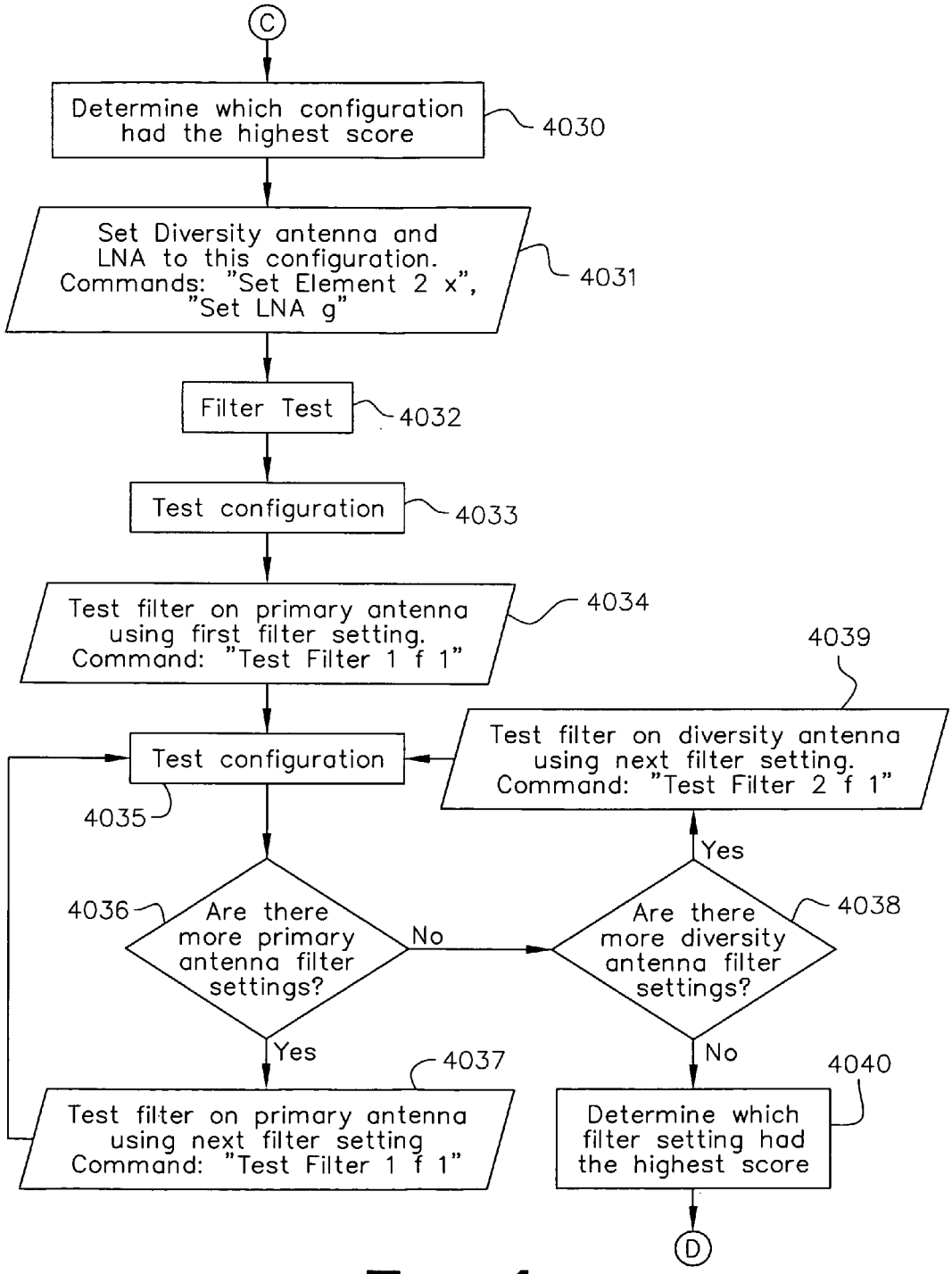

Once all the LNA settings have been tested, as reflected in FIG. 4D, the central server will determine which configuration had the highest link quality score 4030. The secondary antenna bank and LNA will then be set to this configuration 4031.

Next, a filter test 4032 may be conducted with respect to the filters in any filter array utilized. Typically, this will involve a test of the use of no filter versus the use of a particular filter that might enhance signal quality with respect to a given cellular carrier service. The human operator will specify the carrier, and thus, the applicable filter to be tested.

Figure 4E:
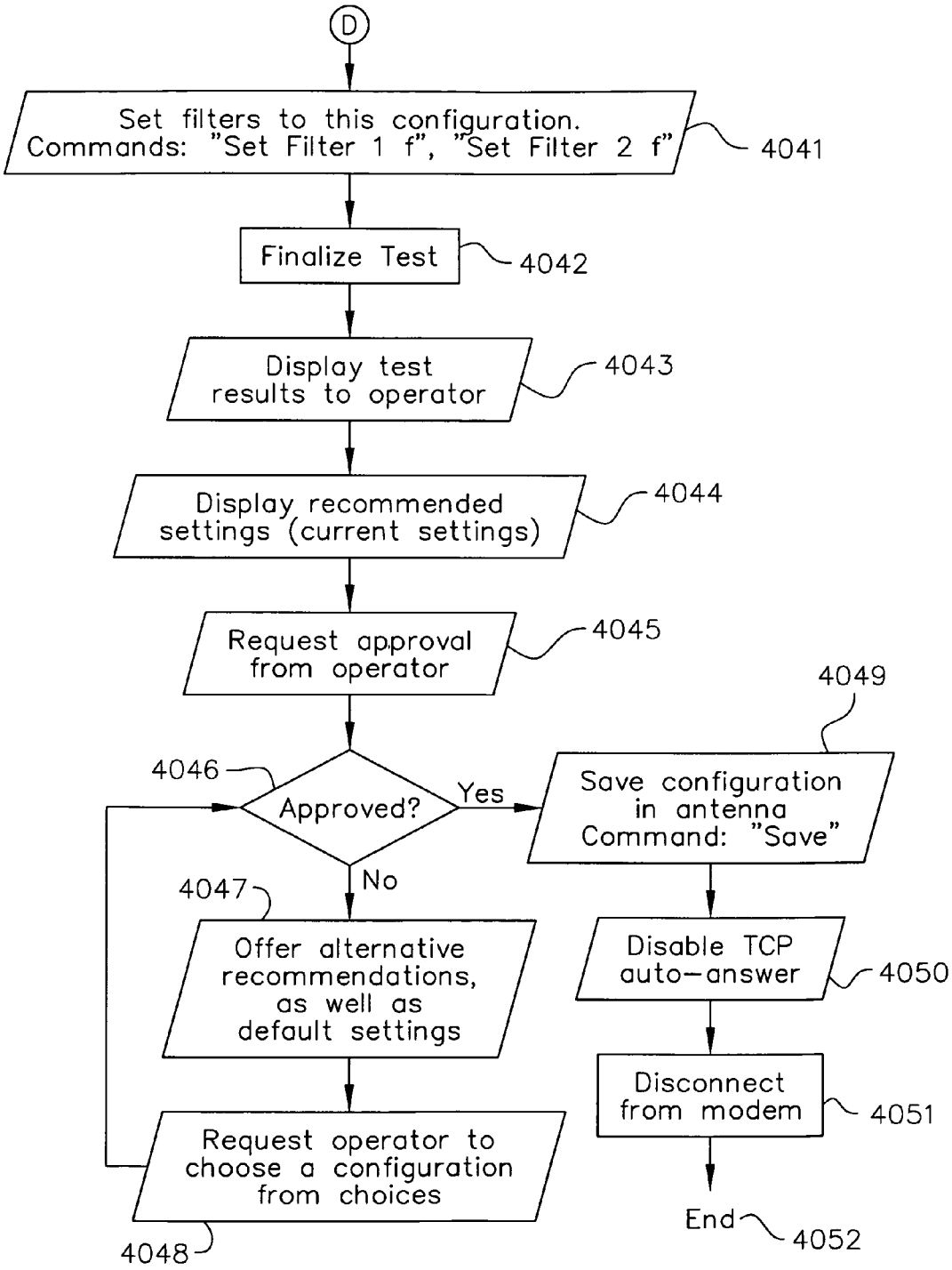

The test may be first conducted with respect to any filter array for the primary antenna bank, and then with respect to any filter array for any secondary antenna bank. The TCM is called, and the system is tested with all filters configured to off 4033. The system then configures a first filter setting with all other filters off 4034, and a test is taken with that single filter enabled 4035. If there are any untested primary antenna filter settings to be tested 4036, the next filter is enabled with all other filters disabled 4037, and the filter test is run on that next untested filter setting 4035. When there are no more primary antenna bank filter settings to be tested, the system queries whether there are any diversity antenna bank filter settings remaining to be tested 4038, then proceeds to configure each filter setting for the diversity antenna bank 4039 and test each configuration for the diversity antenna bank 4035. When there are no more diversity antenna bank filter settings remaining untested, the central server then determines which filter configuration produced the highest link quality score 4040. As illustrated in FIG. 4E, the central server issues a command to the SPA controller to set the filters for each bank to the filter configuration as optimized for each bank 4041.

The system then proceeds to finalize the test 4042 by first displaying to the human operator the test results 4043 and the recommended settings 4044, which would be the current settings for the SPA terminal based on the results provided by the TCM. Typically, an overall link quality score of 750 or more would be considered optimal, a score of 600 to 750 would be considered good, and a score under 600 would be considered out of tolerance.

The human operator would be requested to approve the current settings 4045. The human operator would then input approval or disapproval of the current settings 4046. If those current settings were not approved, the system would offer the human operator alternative settings 4047, which would include settings with lower scores, as well as a default setting, which would involve setting the primary antenna bank to operate omni-directionally and turning the secondary antenna bank off, and ask the human operator to approve one of the alternative settings 4048. The system could also return a designated score indicating a wholesale failure of the installation, in that case giving the human operator no choices of configuration.

If the human operator approves a configuration choice that is offered, the central server sends a command to the SPA controller to save the configuration choice 4049, the central server directs the TCP auto-answer to be disabled 4050, and the central server disconnects from the field modem 4051. The process then ends 4052.

Figure 5:
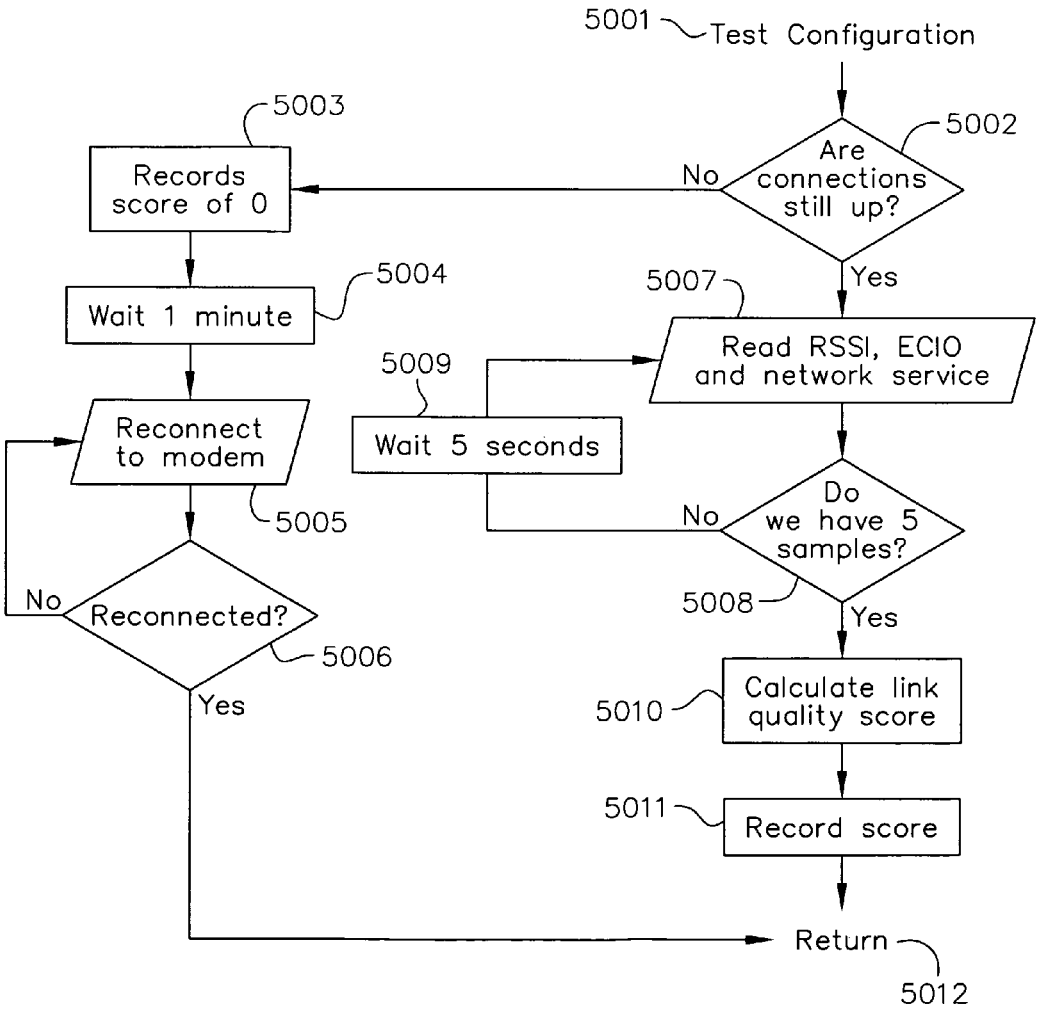

FIG. 5 is a flowchart illustrating the operation of the TCM. The TCM runs in conjunction with a calculate link quality score module (CLQSM) to return a link quality score for a given configuration of the field equipment. When the TCM is called 5001, it initially checks to see whether any connection between the central server and the SPA controller is still active 5002. If not, the TCM records a link quality score of zero 5003 and waits one minute 5004 while the central server attempts to reconnect to the field modem 5005. The system then determines whether reconnection had occurred 5006. If not, the system will continue trying to reconnect until connection is established or the human operator aborts the test.

If the connection between the central server and the field modem is verified, the TCM proceeds to measure the RSSI, EC/IO, and data rate standards associated with the configuration 5007. The system will then inquire whether a designated number of samples, typically five, has been acquired 5008. If the designated number of samples has not yet been acquired, it will wait five seconds 5009, and then will take these measurements again. When the designated number of samples has been acquired, the TCM calls the CLQSM 5010 to calculate a link quality score. Finally, the TCM records the resulting link quality score 5011 and returns to the main process flow 5012.

FIG. 6 A-E presents a flow chart for the CLQSM process. The CLQSM calculates a link quality score, which is an integer reflecting the quality of the signal received from a given configuration of the SPA terminal based on RSSI, EC/IO, and data rate standard samples collected by the TCM. As reflected in FIG. 6A, when the CLQSM is invoked 6001, it first sets the temporary link quality score to zero 6002, then calculates the average RSSI value based on the RSSI samples taken by the TCM 6003 and determines a value for the maximum RSSI change between any two consecutive RSSI samples among all sets of consecutive RSSI samples 6004. As reflected in FIG. 6 A-B, the CLQSM then calculates an RSSI link quality score component based on: 1) whether the average RSSI value exceeds one of a designated number of threshold average RSSI values 6005 A-D (which in the illustrated embodiment consist of four values, being −73, −83, −88, and −95); and 2) whether the maximum change between any two consecutive RSSI samples equals or is less than a designated maximum RSSI change value, typically 6.0 6006. The designated threshold average RSSI values, the number of such values used in the calculation, and the designated maximum RSSI change value may be varied based on an evaluation of relative historical RSSI data for cellular carriers. An applicable RSSI link quality score component 6007 A-J is then added to the temporary link quality score, depending upon the designated threshold average RSSI value exceeded and whether the maximum change between RSSI values exceeds the designated maximum RSSI change value.

Figure 6A:
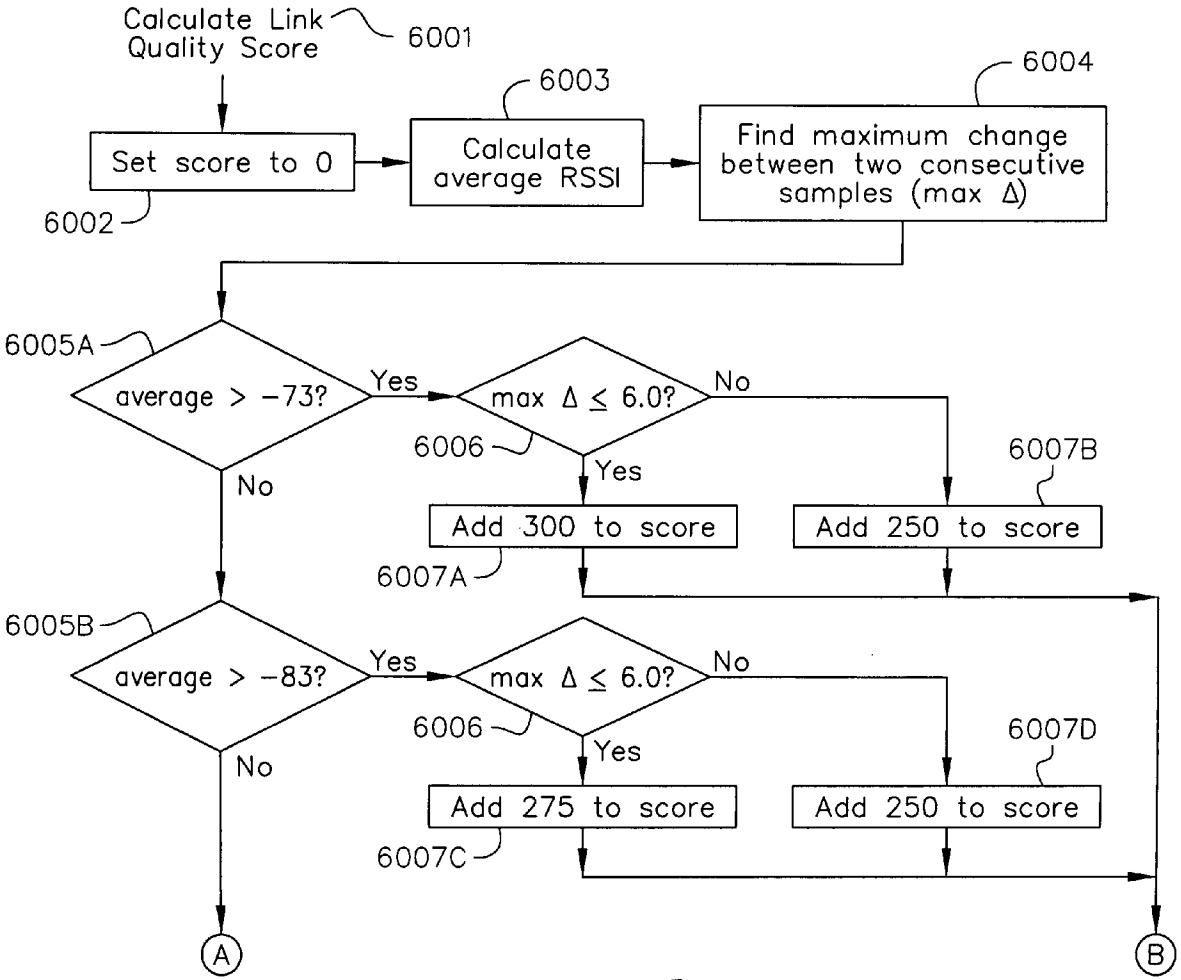
Figure 6B:
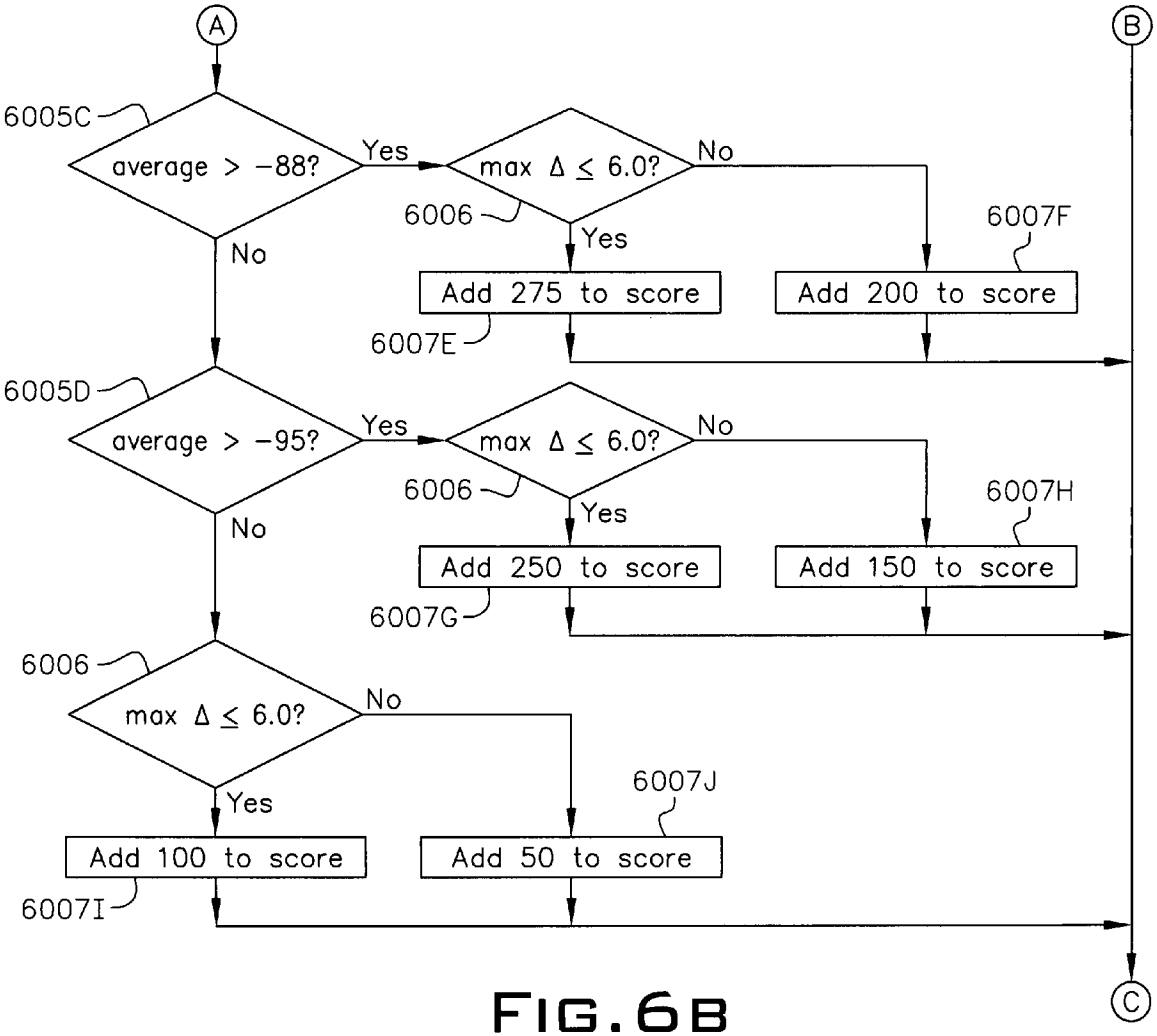
Figure 6C:
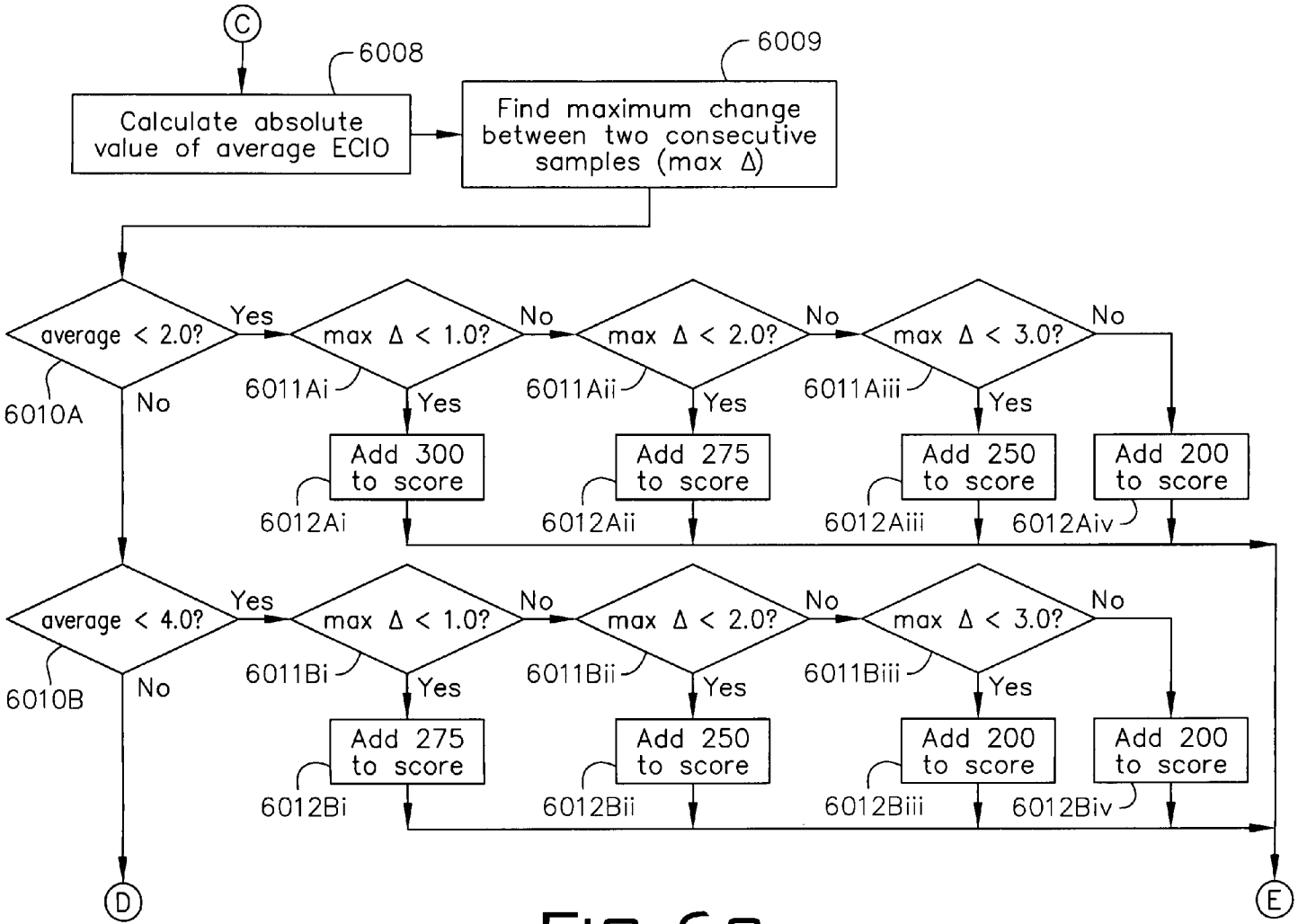
Figure 6D:
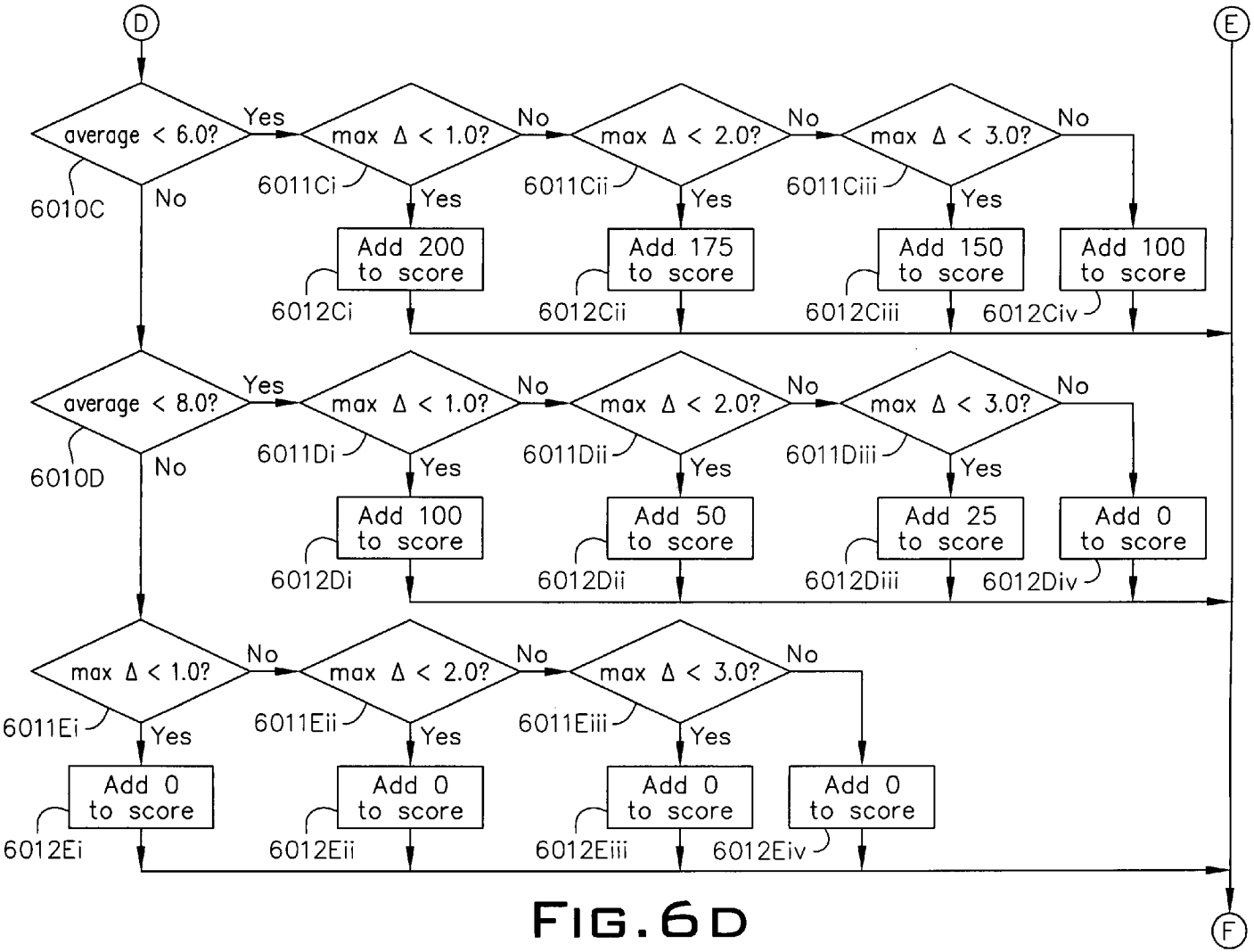

For example, if the average RSSI were −85, this value would be less than −83 6005B (FIG. 6A) but not greater than −88 6005C (FIG. 6B). If the maximum change between two consecutive RSSI samples were 5, which is less than or equal to the designated value of 6.0 6006, then 275 would be added to the link quality score 6007C.

As illustrated in FIG. 6, the CLQSM then proceeds to calculate an EC/IO link quality score component. First, it calculates the absolute value of the average of all the EC/IO samples taken by the TCM (AbAv EC/IO) 6008 and determines the maximum EC/IO change between any two consecutive EC/IO samples among all sets of consecutive EC/IO samples 6009. As reflected in FIG. 6 C-D, the CLQSM then calculates the EC/IO link quality score component based on: 1) whether the absolute value of the average of the EC/IO samples is less than one of a designated number of threshold AbAv EC/IO values (which in the illustrated embodiment consists of four values, being 2.0, 4.0, 6.0, and 8.0) 6010 A-D; and 2) whether the maximum change between consecutive EC/IO samples is or is not less than one of a designated number of threshold maximum EC/IO change values (which in the illustrated embodiment consists of three values, being 1.0, 2.0, and 3.0) 6011 A-E (i-iii). The designated threshold AbAv EC/IO values, the number of such values used in the calculation, and the designated maximum EC/IO change values may be varied based on an evaluation of relative historical RSSI data for a cellular carriers. The CLQSM adds an applicable EC/IO quality link score component to the temporary link quality score 6012 A-E (i-iv).

For example, if the AbAv were 7.5, this would not be less than the designated threshold value of 6.0 6010C (FIG. 6 D), but would be less than the designated threshold value of 8.0 6010D. If the maximum change between consecutive EC/IO samples were 1.75, this would not be less than the designated threshold of 1.0 6011Ci, but would be less than the designated threshold value of 2.0 6011Cii, so 175 would be added to the link quality score 6012Cii.

Figure 6E:
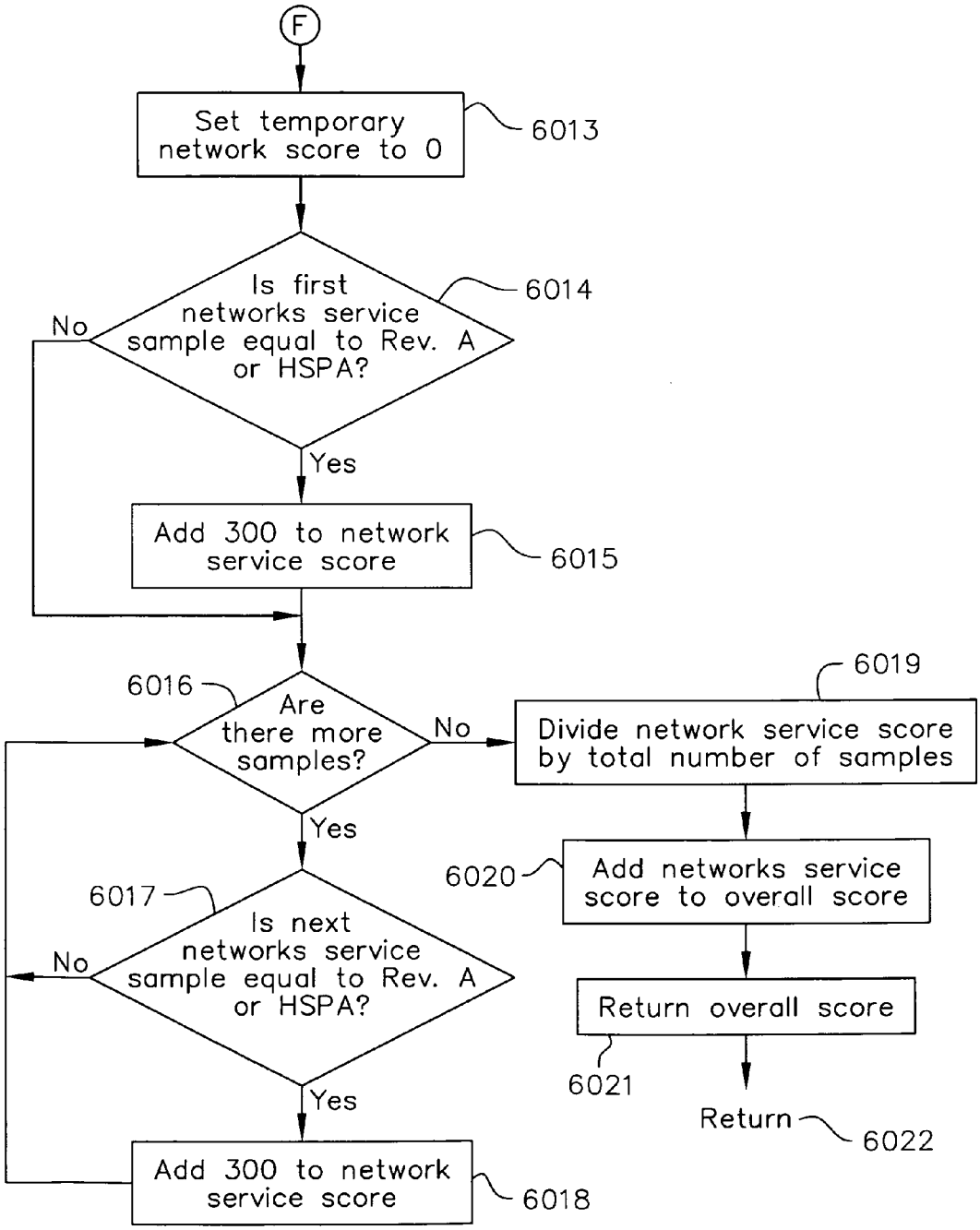

As illustrated in FIG. 6E, the final stage of the CLQSM involves the calculation of a link quality component for data rate standards used to determine the quality of broadband service capability (DRSC) based on the data rate standard samples obtained by the TCM. First, a temporary DRSC is set to zero 6013. The CLQSM then determines whether to augment the temporary DRSC based on an evaluation as to whether a first sample is equal to EV-DO Rev. A or HSPA 6014. If so, the network service score is augmented 6015. The system queries whether there are remaining samples to evaluate 6016, and repeats the process for each additional sample 6017, 6018. When there are no more samples to evaluate, the temporary DRSC is then divided by the number of data rate standard samples to calculate a final DRSC 6019, and the final DRSC is added to the temporary link quality score to produce a final link quality score 6020, which is then returned to the TCM 6021, and the CLQSM terminates by returning to the TCM module that called it 6022.

What is claimed is:

1. A self-provisioning antenna system comprising:

a primary antenna bank and a secondary antenna bank, each of said banks comprising one or more directional radiating elements, said primary antenna bank further comprising means of controlling its orientation and a transmit/receive port coupled via a field modem to a communications medium, and said secondary antenna bank further comprising means of controlling its orientation and a receive-only port coupled via said field modem to a communications medium;

a field controller, comprised of a low-noise microprocessor and a communications interface, coupled to said primary and secondary antenna banks by one or more sets of control lines, and for receiving, acknowledging, and executing commands from a central server to configure the respective orientations of said primary and secondary antenna banks utilizing said means of controlling the orientation of said primary antenna bank and said means of controlling the orientation of said secondary antenna bank, said field controller thence connected via said field modem to said communications medium;

a central server, coupled via a central modem to said communications medium, for receiving field signal quality metrics from said primary antenna bank and said secondary antenna bank via said field modem, calculating one or more values to determine an optimal configuration for the respective orientations of said primary antenna bank and said secondary antenna bank based on said field signal quality metrics, and transmitting commands over said communications medium to said one or more field controllers to implement said respective optimal configurations for said primary antenna bank and for said secondary antenna bank.

2. The self-provisioning antenna system of claim 1, in which the primary antenna bank and the secondary antenna bank are spaced between 6 and 18 inches apart.

3. The self-provisioning antenna system of claim 1, in which the primary antenna bank and the secondary antenna bank each contain four directional radiating elements disposed in a square pattern, each said directional radiating element vertically polarized with a beamwidth of approximately a quadrant.

4. The self-provisioning antenna system of claim 1, in which the communications medium is a celluar telephone network.

5. The self-provisioning antenna system of claim 1, in which the field modem comprises a programmable microprocessor and memory.

6. The self-provisioning antenna system of claim 1 in which the means of controlling the orientation of the primary antenna and the means of controlling the orientation of the secondary antenna each comprise a configuration of RF switches combined to provide a single output.

7. The self-provisioning antenna system of claim 6 in which the RF switches are within an integrated circuit.

8. The self-provisioning antenna system of claim 1, in which at least one of the antenna banks further comprises one or more addressable arrays of filters.

9. The self-provisioning antenna system of claim 8, in which at least one of said arrays has three filters, the first said filter within a range of 869-894 MHz, the second said filter within a range of 1930-1990 MHz, and the third said filter within a range of 2110-2170 MHz.

10. The self-provisioning antenna system of claim 1, in which the secondary antenna bank further comprises a Low Noise Amplifier.

11. The self-provisioning antenna system of claim 1, further comprising an RF Noise Detector.

12. A method for remotely provisioning an antenna based on commands from a central server site, comprising the steps of:

receiving and implementing at a remote terminal site one or more commands from a central server to select a primary antenna bank at said remote terminal site;

receiving and implementing at said remote terminal site one or more commands from said central server to configure said primary antenna bank by activating one or more directional radiating elements comprising said primary antenna bank;

measuring at said remote terminal site field signal quality metrics for each configuration of said primary antenna bank;

transmitting said field signal quality metrics for each configuration of said primary antenna bank from said remote terminal site to said central server;

receiving at said remote terminal site a command from said central server to implement a particular configuration for said primary antenna bank based on said field signal quality metrics for each configuration of said primary antenna bank, receiving and implementing at said remote terminal site one or more commands from a central server to select a secondary antenna bank at said remote terminal site;

receiving and implementing at said remote terminal site one or more commands from said central server to configure said secondary antenna bank by activating one or more directional radiating elements comprising said secondary antenna bank;

measuring at said remote terminal site field signal quality metrics for each configuration of said secondary antenna bank;

transmitting said field signal quality metrics for each configuration of said secondary antenna bank from said remote terminal site to said central server;

receiving at said remote terminal site a command from said central server to implement a particular configuration for said secondary antenna bank based on said field signal quality metrics for each configuration of said secondary antenna bank.

13. The method of claim 12, further comprising the steps of:

receiving and implementing at said remote terminal site one or more commands from said central server to further configure said primary antenna bank by activating one or more filters within one or more filter banks coupled to said primary antenna bank; and receiving and implementing at said remote terminal site one or more commands from said central server to further configure said secondary antenna bank by activating one or more filters within one or more filter banks coupled to said secondary antenna bank.

14. The method of claim 12, further comprising the steps of:

receiving and implementing at said remote terminal site one or more commands from said central server to further configure said secondary antenna bank by activating one or more low noise amplifiers coupled to said secondary antenna bank.

15. The method of claim 13, further comprising the steps of:

receiving and implementing at said remote terminal site one or more commands from said central server to further configure said secondary antenna bank by activating one or more low noise amplifiers coupled to said secondary antenna bank.

16. A method for remotely provisioning an antenna from a central server site, comprising the steps of:

transmitting one or more commands to a remote terminal site to select a primary antenna bank at said remote terminal site;

transmitting to said remote terminal site one or more commands to configure one or more directional radiating elements comprising said primary antenna bank;

receiving from the remote terminal site field signal quality metrics for each configuration of said primary antenna bank;

calculating a link quality score for each different configuration of said primary antenna bank based on said field signal quality metrics for each configuration of said primary antenna bank;

determining which configuration of said primary antenna bank produced the highest link quality score;

transmitting to said remote terminal site one or more commands to configure the one or more directional radiating elements within said primary antenna bank based upon said field signal quality metrics for each configuration of said primary antenna bank;

transmitting one or more commands to a remote terminal site to select a secondary antenna bank at said remote terminal site;

transmitting to said remote terminal site one or more commands to configure one or more directional radiating elements comprising said secondary antenna bank;

receiving from the remote terminal site field signal quality metrics for each configuration of said secondary antenna bank;

calculating a link quality score for each different configuration of said secondary antenna bank based on said field signal quality metrics for each configuration of said secondary antenna bank;

determining which configuration of said secondary antenna bank produced the highest link quality score; and transmitting to said remote terminal site one or more commands to configure the one or more directional radiating elements within said secondary antenna bank based upon said field signal quality metrics for each configuration of said secondary antenna bank.

17. The method of claim 16, further comprising the steps of:

transmitting to said remote terminal site one or more commands from said central server to further configure said primary antenna bank by activating one or more filters within one or more filter banks coupled to said primary antenna bank; and transmitting to said remote terminal site one or more commands from said central server to further configure said secondary antenna bank by activating one or more filters within one or more filter banks coupled to said secondary antenna bank.

18. The method of claim 16, further comprising the steps of:

transmitting to said remote terminal site one or more commands from said central server to further configure said secondary antenna bank by activating one or more low noise amplifiers coupled to said secondary antenna bank.

19. The method of claim 17, further comprising the steps of:

transmitting to said remote terminal site one or more commands from said central server to further configure said secondary antenna bank by activating one or more low noise amplifiers coupled to said secondary antenna bank.

* * * * *